US012448964B2

(12) United States Patent
Qiu et al.

(10) Patent No.: US 12,448,964 B2
(45) Date of Patent: Oct. 21, 2025

(54) METERING DISTRIBUTION ASSEMBLY AND COATING SYSTEM COMPRISING THE SAME

(71) Applicant: NORDSON CORPORATION, Westlake, OH (US)

(72) Inventors: Peter Qiu, Shanghai (CN); William Zheng, Shanghai (CN)

(73) Assignee: Nordson Corporation, Westlake, OH (US)

( * ) Notice: Subject to any disclaimer, the term of this patent is extended or adjusted under 35 U.S.C. 154(b) by 88 days.

(21) Appl. No.: 18/040,993

(22) PCT Filed: Aug. 11, 2021

(86) PCT No.: PCT/US2021/045482
§ 371 (c)(1),
(2) Date: Feb. 8, 2023

(87) PCT Pub. No.: WO2022/035927
PCT Pub. Date: Feb. 17, 2022

(65) Prior Publication Data

US 2023/0286012 A1 Sep. 14, 2023

(30) Foreign Application Priority Data

Aug. 12, 2020 (CN) ..... 202010806091.3

(51) Int. Cl.
*F04C 2/08* (2006.01)
*F04C 15/00* (2006.01)
*F04C 15/06* (2006.01)

(52) U.S. Cl.
CPC ..... *F04C 2/084* (2013.01); *F04C 15/0042* (2013.01); *F04C 15/06* (2013.01);
(Continued)

(58) Field of Classification Search
CPC ..... F04C 2/082; F04C 2/084; F04C 2/126; F04C 2/14; F04C 2/18; F04C 13/002;
(Continued)

(56) References Cited

U.S. PATENT DOCUMENTS 6,171,089 B1 1/2001 Oehman
6,296,463 B1 10/2001 Allen
(Continued)

FOREIGN PATENT DOCUMENTS

GB 2029732 A 3/1980
JP 09-075819 A 3/1997
(Continued)

OTHER PUBLICATIONS

International Patent Application No. PCT/US2021/045482; Int'l Search Report and the Written Opinion; dated Nov. 24, 2021; 15 pages.

*Primary Examiner* — Theresa Trieu
(74) *Attorney, Agent, or Firm* — BakerHostetler

(57) ABSTRACT

A metering distribution assembly and a coating system. The metering distribution assembly includes a volumetric cavity pump that comprises a flow passage plate having flow passages, a nozzle plate with a flow passage, a gear fixing plate attached between the flow passage plate and the nozzle plate, and a gear set located in an aperture of the fixing plate. The gear set has a fluid inlet and a fluid outlet on a side of the gear set opposite to the fluid inlet. The fluid inlet is in fluid communication with the flow passages of the flow passage plate, and the fluid outlet is in fluid communication with the flow passage of the nozzle plate. A part of the flow passages of the flow passage plate, which is in direct fluid communication with the fluid inlet, extends in a direction parallel to a rotation axis of the gear set.

20 Claims, 12 Drawing Sheets

(52) U.S. Cl.
CPC ..... *F04C 15/064* (2013.01); *F04C 2220/24* (2013.01); *F04C 2240/806* (2013.01)

(58) Field of Classification Search
CPC ..... F04C 15/06; F04C 15/064; F04C 15/066; F04C 15/0023; F04C 15/0026; F04C 15/0042; F04C 2220/24; F04C 2240/30; F04C 2240/806
See application file for complete search history.

(56) References Cited

U.S. PATENT DOCUMENTS

| | | | | |
|---|---|---|---|---|
| 8,272,537 | B2 | 9/2012 | Varga | |
| 2004/0191103 | A1 | 9/2004 | Gotschhofer | |
| 2004/0213680 | A1 | 10/2004 | Suzuki et al. | |
| 2009/0206112 | A1* | 8/2009 | Fort | B05C 5/001 222/1 |
| 2019/0358664 | A1 | 11/2019 | Ikushima | |

FOREIGN PATENT DOCUMENTS

| | | | |
|---|---|---|---|
| JP | 11-223184 | A | 8/1999 |
| JP | 2004-278502 | A | 10/2004 |
| JP | 2004-301125 | A | 10/2004 |
| JP | 2011-147900 | A | 8/2011 |

* cited by examiner

METERING DISTRIBUTION ASSEMBLY AND COATING SYSTEM COMPRISING THE SAME

CROSS REFERENCE TO RELATED APPLICATIONS

This application is a National Stage Application of International Patent App. No. PCT/US2021/045482, filed Aug. 11, 2021, which claims priority to Chinese Patent Application No. 202010806091.3, filed Aug. 12, 2020, the entire disclosures of both of which are hereby incorporated by reference as if set forth in their entirety herein.

TECHNICAL FIELD

The present invention relates to a metering distribution assembly composed of a volumetric cavity pump comprising: a flow passage plate provided with flow passages for fluid flow; a nozzle plate provided with a flow passage through the nozzle plate; a gear fixing plate attached between the flow passage plate and the nozzle plate and having an aperture; and a gear set located in the aperture of the gear fixing plate, the gear set having a fluid inlet and a fluid outlet on a side of the gear set opposite to the fluid inlet, the fluid inlet being in fluid communication with the flow passages of the flow passage plate, and the fluid outlet being in fluid communication with the flow passage of the nozzle plate.

The present invention also relates to a coating system comprising the metering distribution assembly.

BACKGROUND ART

Hot-melt adhesives are widely used in a variety of applications. In some applications, relatively high bond strength is required, and polyurethane reactive hot-melt adhesives have been used due to their relatively high bond strength. However, other characteristics of these adhesives bring various manufacture difficulties. For example, the polyurethane reactive hot-melt adhesive reacts with the atmosphere, and thus must be melted in a closed container. Therefore, a typical adhesive supply system associated with the polyurethane reactive hot-melt adhesive includes a sealed melter unit that supplies the heated adhesive to a gear pump. Then, the adhesive is supplied to a distribution head through a heated hose to maintain the desired temperature.

When the polyurethane reactive hot-melt adhesive is used in an application that requires a relatively small amount of adhesive per unit, such as the sealing of a battery pack for a personal computer, the residence time of the adhesive in the heated hose may exceed a "pot life" of the adhesive, and it is possible that the adhesive cannot be distributed in an accurate amount.

In order to accurately coat a small amount of hot-melt glue onto a workpiece, a variety of dedicated volumetric cavity pump distributors have been developed rapidly. At present, there are a large number of existing distributors to be tested for this typical application. However, when the prior art distributor is operated, obvious droplets accumulated at the tip of the nozzle can always be observed. In this regard, a programmable motor reversal function has been developed in the intelligent controller software for reverse pumping. Nevertheless, glue leakage from the tip of the nozzle still seems to be inevitable.

Thus, at the end of the coating of the adhesive, adhesive ends are usually formed and accumulated on the surface of the coated object, which leads to an unsatisfactory appearance and even adversely affects the quality of the product. In addition, the maintenance of the coating system is usually time-consuming and laborious.

It is desirable to provide a distribution system that can accurately distribute a relatively small amount of adhesive. In addition, it is desirable to provide a distribution system that is compact, easy to maintain, and responsive.

SUMMARY OF THE INVENTION

An object of the present invention is to provide a volumetric cavity pump (VCP)-embedded coating system, which removes the above-mentioned defects in the prior art.

According to a first aspect of the present invention, there is provided a metering distribution assembly composed of a volumetric cavity pump comprising: a flow passage plate having flow passages for fluid flow; a nozzle plate provided with a flow passage through the nozzle plate; a gear fixing plate attached between the flow passage plate and the nozzle plate and having an aperture; and a gear set located in the aperture of the gear fixing plate, the gear set having a fluid inlet and a fluid outlet on a side of the gear set opposite to the fluid inlet, the fluid inlet being in fluid communication with the flow passages of the flow passage plate, and the fluid outlet being in fluid communication with the flow passage of the nozzle plate, wherein a part of the flow passages of the flow passage plate, which is in direct fluid communication with the fluid inlet, extends in a direction parallel to a rotation axis of the gear set.

Thus, with the above-mentioned volumetric cavity pump-embedded metering distribution assembly, a pressure difference of the gear set on both sides in a mounting plane of the gear set can eliminated, and molten glue can be prevented from passing through a meshing part of the gear set, thereby a fluid such as hot-melt glue can be distributed with relatively high precision.

Preferably, the flow passage plate has a first flow passage, a second flow passage and a third flow passage, the first flow passage extending in a direction parallel to an axis of the barrel assembly and receiving a fluid from the barrel assembly, the second flow passage fluidly communicating the first flow passage and the third flow passage, and the third flow passage being in direct fluid communication with the fluid inlet.

Thus, with the above-mentioned volumetric cavity pump-embedded metering distribution assembly, the processing operation can be made easy, and the fluid such as hot-melt glue can be distributed with relatively high precision.

Preferably, the gear set includes a driving gear and a driven gear, the driving gear being driven to rotate by the driving assembly, thereby driving the driven gear to rotate, wherein addendum height coefficients of the driving gear and the driven gear are greater than addendum clearance coefficients thereof.

Thus, with the gear being specially designed, a very small volume can be obtained with high precision for each revolution.

Preferably, the addendum height coefficient is 0.7, and the addendum clearance coefficient is 0.3.

Thus, optimal fluid transport performance can be obtained.

Preferably, the driven gear has a gear shaft.

Preferably, one end of the gear shaft is inserted into the flow passage plate, and the other end thereof is inserted into the nozzle plate.

Thus, a shaft of the driven gear is not only used for gear rotation, but is also called a positioning pin shaft. It plays a very important role in the precise positioning of a nozzle plate, a gear fixing plate and a top glue passage plate. Fundamentally, this design is completely different from any existing metering system (a separate gear pump is usually mounted thereon).

Preferably, the flow passage of the nozzle plate is straight.

Thus, the manufacture cost is relatively low; a good cut-off line end pattern can be obtained without end accumulation; the maintenance is convenient; and the outflow length is short, which is suitable for a high-viscosity material and the like.

Preferably, a pressure control check valve is provided in the flow passage of the nozzle plate to open or close the flow passage.

With the above configuration, the present invention can solve a leakage problem of the fluid such as hot-melt glue at a lower cost.

Preferably, the metering distribution assembly is provided with a control valve assembly with a needle, for opening or closing the flow passage in the metering distribution assembly.

With the above configuration, the intelligent metering distribution assembly embedded with the VCP in the present invention can permanently solve the leakage problem of the fluid such as hot-melt glue.

Preferably, the control valve assembly is an integral component attached to the nozzle plate. The flow passage of the nozzle plate is a straight flow passage inclined with respect to the rotation axis of the gear set. Alternatively, the flow passage of the nozzle plate includes a first flow passage and a second flow passage, the first flow passage extending from the fluid outlet of the gear set, the second flow passage extending at an angle to the first flow passage and being in fluid communication with a needle passage.

Thus, the design of the flow passage is optimized and the manufacture cost is reduced.

Preferably, the control valve assembly includes a needle housing and a top cover, the top cover being attached to the needle housing to form an internal space, in which one end of the needle is accommodated; the flow passage of the nozzle plate includes a first flow passage, a second flow passage and a third flow passage, the first flow passage extending from the fluid outlet of the gear set, the second flow passage fluidly communicating the first flow passage and the third flow passage, the third flow passage extending to a discharge port of the nozzle plate; and the needle housing of the control valve assembly is attached to the nozzle plate, so that the other end of the needle of the control valve assembly is movable in the third flow passage to control distribution of the fluid from the nozzle plate.

Thus, the control valve assembly is of a combined design. Therefore, it is easy to replace parts or perform maintenance, and the formation of large ends of the glue can be effectively reduced after the coating operation is stopped.

Preferably, on a side of the flow passage plate facing the gear set, a groove is formed in an area corresponding to the fluid outlet of the gear set. Thus, a high hydraulic pressure trapped by meshed gear teeth is reduced.

Preferably, a plug rod is provided, which is designed to be inserted into the second flow passage of the flow passage plate, for eliminating a fluid dead end in the second flow passage. Thus, the fluid dead end is eliminated, and a glue passage path for glue passage cleaning and maintenance is improved.

Preferably, a thickness of the gears of the gear set is of the same nominal size as a thickness of the gear fixing plate.

According to a second aspect of the present invention, there is provided a coating system comprising: a barrel assembly comprising a barrel for accommodating a fluid; the aforementioned metering distribution assembly attached to and in fluid communication with the barrel assembly; and a driving assembly for driving the metering distribution assembly to distribute the fluid from the barrel assembly via the metering distribution assembly.

This coating system can eliminate a pressure difference of the gear set on both sides in a mounting plane of the gear set, and can prevent the molten glue from passing through a meshing part of the gear set, thereby distributing a fluid such as hot-melt glue with relatively high precision.

BRIEF DESCRIPTION OF THE DRAWINGS

These and other objects and advantages of the present invention will be embodied more fully in combination with the following description of the drawings, wherein the same reference signs indicate the same or similar parts in all the drawings, and wherein.

DETAILED DESCRIPTION OF THE EMBODIMENTS

Hereinafter, the embodiments according to the present invention will be described in detail with reference to the drawings. In the description of the drawings, the same or corresponding parts are indicated by the same numbers and symbols, and repeated description will be omitted.

In the following description, the terms "up", "down", "left", "right", "front", "rear", etc. (if any) indicating directions are only used to describe the drawings, and do not constitute substantive limitations to the present invention.

Figure 1:
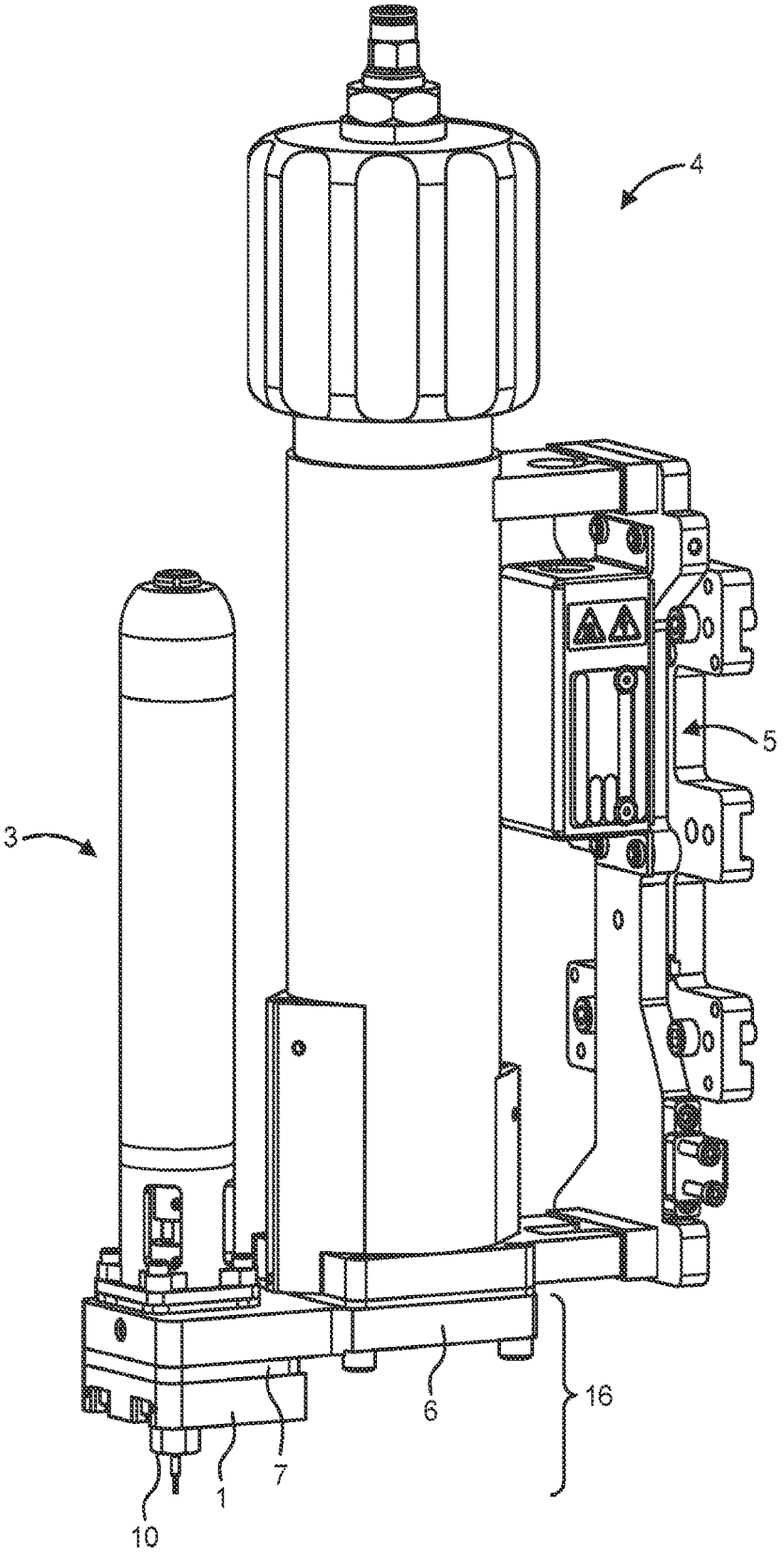
FIG. 1 is a perspective view of a coating system embedded with the VCP according to a first embodiment of the present invention.
Figure 2:
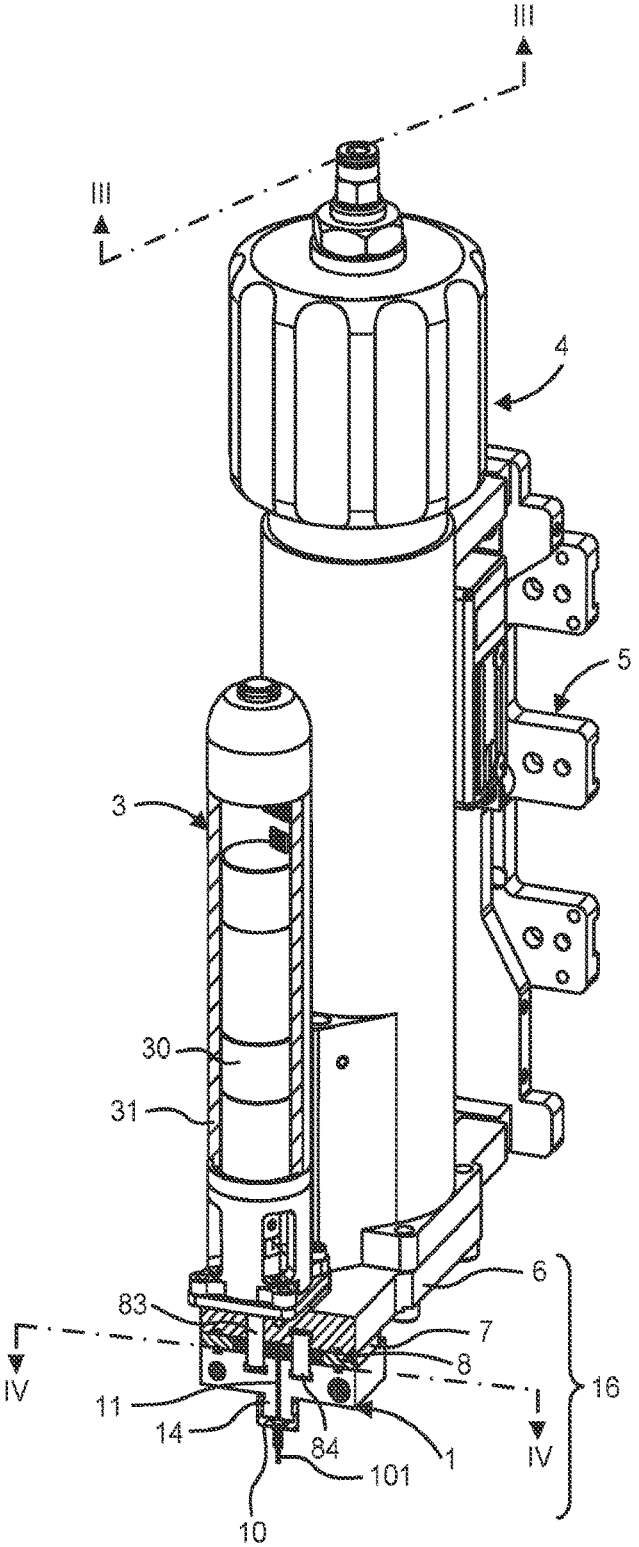
FIG. 2 is a view showing the driving assembly and VCP of the coating system in a cross-sectional form.

FIG. 1 is a perspective view of a coating system embedded with the VCP according to a first embodiment of the present invention, and FIG. 2 is a view showing the driving assembly and VCP of the coating system in a cross-sectional form. The coating system embedded with the VCP according to the present invention is used to distribute a fluid. Referring to FIG. 1, the coating system usually comprises a barrel assembly 4, and a metering distribution assembly 16 coupled to the barrel assembly 4 for selectively distributing the fluid. The coating system further comprises a driving assembly 3 for driving the metering distribution assembly 16. A barrel or syringe (not shown) for storing the fluid may be placed in the barrel assembly 4. The fluid is, for example and not limited to, a reactive hot-melt adhesive, which is, for example, an adhesive containing a polyurethane resin and a two-component polymer material, or another adhesive containing any ambient-temperature or hot-melt material. The hot-melt material is known to exhibit a viscosity change during an expected life of the barrel containing the hot-melt material.

Figure 3:
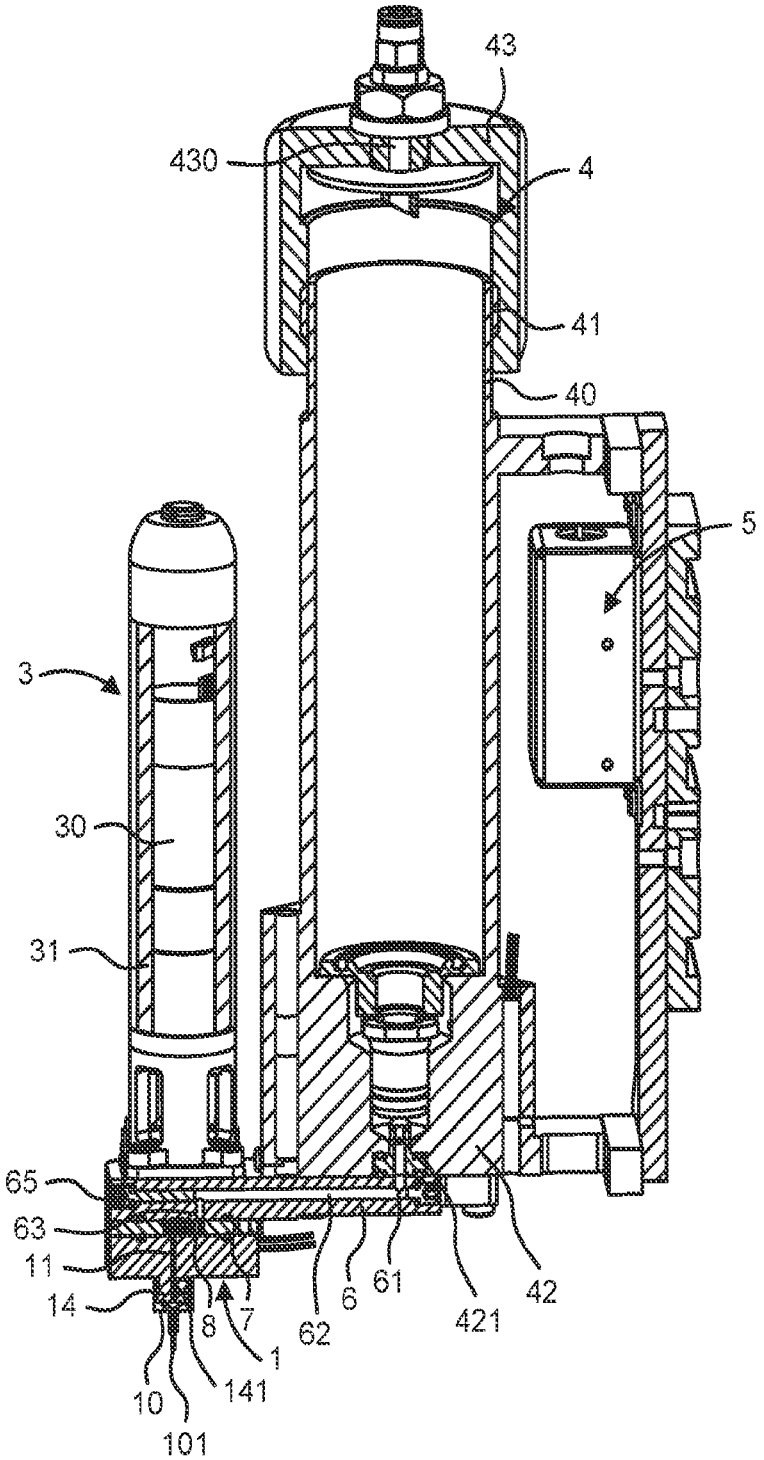
FIG. 3 is a cross-sectional view taken along the line in FIG. 2.

FIG. 3 is a cross-sectional view taken along the line in FIG. 2. Referring to FIG. 3, the barrel assembly 4 includes a barrel sleeve or housing 40, which may be in the form of a heated cylinder or another form, and is configured to receive a disposable barrel containing a fluid therein. At room temperature, the fluid may be a solid material, such as an adhesive in solid form. In this regard, the housing 40 may be heated so that the heat transfer from the housing 40 to the barrel changes the solid material or at least maintains it in a molten state. The barrel may be heated or not heated before being inserted into the housing 40, or if heated, the material in the barrel may already be in a molten state when the barrel is inserted into the housing 40. In order to facilitate heating of the housing 40, the barrel assembly 4 may include one or more heating elements, such as a heating barrel, and one or more temperature measuring devices, such as a resistance temperature detector, and the temperature measuring devices allow the heat supplied to the housing 40 to be controlled (for example, measured and adjusted) in a manner known in the art. The housing 40 has a proximal end 41 and a distal end 42, the proximal end 41 being located upstream in a barrel insertion direction, and the distal end 42 being located downstream in the barrel insertion direction. The barrel insertion direction is consistent with a longitudinal axis of the barrel assembly 4. According to requirements, the barrel may be provided with a check valve, and, preferably, a check valve is provided at the bottom of the barrel to prevent the fluid from reversing.

Preferably, the barrel has a capacity of 30 cc or 300 cc. The barrel is inserted through an opening at the proximal end 41 of the housing 40 and is received in an internal space of the housing 40. The internal space has a shape matching the shape of the barrel, so that the barrel is tightly fitted inside the housing 40. A cover 43 is attached to, for example, screwed to the housing 40, specifically to an outer circumference of the proximal end 41 of the housing 40. The cover 43 allows the barrel to be coupled with respect to the housing 40, thereby helping to accommodate the barrel in the housing 40. Specifically, the cover 43 is connected to the proximal end 41 of the housing 40 and is fixed with respect to the housing 40 by rotation (e.g., ¼ turn rotation) of the cover 43. Once the cover 43 is fixedly coupled with the housing 40, the barrel is inserted into the internal space of the housing 40 and is fixed with respect to the housing 40, for example.

The barrel receives pressurized air from a suitable external source through the cover 43 for applying a pressure to the fluid in the barrel, and the housing 40 includes a discharge port 421 at its distal end 42 for discharging the fluid under the pressure from the housing 40 to the outside of the barrel assembly 4, specifically to the metering distribution assembly 16. Specifically, the cover 43 has an openable and closable cover passage 430 that can communicate the inside of the barrel with an external source of air. The cover passage 430 receives air having a pressure of, for example, between about 5 psi and about 10 psi from the external source of air. It is conceivable that a piercing element may be provided, which is configured to penetrate the cover 43 to reach a main volume of the fluid. The inside of the barrel is pressurized with pressurized air to promote the distribution of the fluid toward the outside of the barrel, such as the metering distribution assembly 16.

The metering distribution assembly 16 has the form of a volumetric cavity pump, and is coupled to the barrel assembly 4 in a manner to be described below so as to distribute a precise amount of fluid from the barrel assembly 4. As shown in FIGS. 1-3, the metering distribution assembly 16 includes a flow passage plate 6 at the top, a nozzle plate 1 at the bottom, a gear fixing plate 7 connected between the flow passage plate 6 and the nozzle plate 1, and a gear set 8 located in the gear fixing plate 7. The flow passage plate 6, the nozzle plate 1, the gear fixing plate 7 and the gear set 8 together constitute a volumetric cavity pump. The flow passage plate 6 is connected to the barrel assembly 4, specifically to a lower end 42 of the barrel assembly 4, and is in fluid communication with the barrel assembly 4. The gear fixing plate 7 is hermetically connected between the flow passage plate 6 and the nozzle plate 1 by a sealing ring, for example. The nozzle plate 1 is provided with a flow passage 11 through the nozzle plate 1. In the prior art, the metering distribution assembly may include, for example and not limited to, a piston pump, a screw pump, a metering rod pump, a cycloid pump, and/or a peristaltic pump. The difference from those is that the metering distribution assembly 16 of the present invention includes a volumetric cavity pump having specially designed flow passages and gear set 8, specifically as described below. The volumetric cavity pump according to the embodiment allows to distribute a desired amount of fluid independently of any viscosity change experienced by the fluid when stored in the barrel before being used.

As shown in FIG. 3, the gear set 8 is arranged in the gear fixing plate 7 in a manner well known in the prior art, and is located on the nozzle plate 1. The flow passage plate 6 includes a plurality of flow passages, a part of which extends in a direction parallel to a rotation axis of the gear set 8 and is in direct fluid communication with the fluid inlet 85 (see FIG. 4) of the gear set 8. Preferably, the rotation axis of the gear set 8 is parallel to the barrel insertion direction. In the prior art, an inflow direction of the gear set is generally perpendicular to the rotation axis of the gear set and an outflow direction thereof is generally parallel to the rotation axis of the gear set, or the fluid inlet and the fluid outlet of the gear set are located on the same mating surface. In addition, in this case, this type of mounting may negatively affect the final distribution performance. Specifically, the fluid from the barrel assembly causes an impact on the gear set, so that a part of the fluid may directly pass through a meshing part of the gear set to reach the fluid outlet, and thus the distribution accuracy of the fluid is low. In contrast, in the present invention, a part of the flow passages of the flow passage plate 6 extends in a direction parallel to the rotation axis of the gear set 8 and is in direct fluid communication with the fluid inlet 85 of the gear set 8, that is, a part of the flow passages of the flow passage plate 6, which is in direct fluid communication with the fluid inlet 85 of the gear set 8, is perpendicular to a gear plane of the gear set 8, so an inlet passage and an outlet passage of the gear set are arranged on opposite sides of the gear set on the rotation axis. Accordingly, the fluid from the barrel assembly does not directly impose an impact on the gear set, and helps to maintain the force balance of the gear set in an up and down direction, thereby improving the distribution accuracy of the fluid.

Specifically, as shown in FIG. 3, the flow passage plate 6 has a first flow passage 61, a second flow passage 62 and a third flow passage 63, the first flow passage 61 extending in a direction parallel to the longitudinal axis of the barrel assembly 4 and receiving the fluid from the barrel assembly 4, the second flow passage 62 fluidly communicating the first flow passage 61 and the third flow passage 63, and the third flow passage 63 extending in a direction parallel to the rotation axis of the gear set 8 and being in direct fluid communication with the fluid inlet 85 (see FIG. 4) of the gear set 8. The fluid from the third flow passage 63 does not directly impact the gear set in an in-plane direction of the gear set, thereby improving the distribution accuracy of the fluid.

As shown in FIGS. 1-3, the nozzle plate 1 of the metering distribution assembly 16 is in fluid communication with the gear set 8 of the metering distribution assembly 16. The flow passage 11 of the nozzle plate 1 penetrates the nozzle plate 1 in the up and down direction. The nozzle plate 1 has a main body and a protrusion 14 protruding from the main body. The flow passage 11 penetrates the main body and the protrusion 14, and preferably has a linear form. A nozzle 10 may be coupled to the protrusion 14 of the nozzle plate 1 by threads, for example. The nozzle plate 1, and specifically, the protrusion 14 of the nozzle plate 1 has a discharge port 141. The nozzle 10 can control various aspects of fluid distribution.

The nozzle 10 can control different aspects of fluid distribution. The nozzle 10 may be adapted to control, for example and not limited to, the thickness and/or flow direction of the fluid distributed to the outside of the barrel assembly 4. Further, the nozzle plate 1 and/or the nozzle 10 may be heated, for example, with an optional heater, so as to maintain the fluid in a molten state when the fluid completely leaves the nozzle 10. Alternatively or additionally, the nozzle plate 1 and/or the nozzle 10 may receive heat by conduction from the heated housing 40. The nozzle 10 has a thin-walled hollow tube 101 that can determine, for example, the diameter of a final filament of the fluid distributed via the nozzle 10. The thin-walled hollow tube 101 is aligned with and in fluid communication with the discharge port 141 of the nozzle plate 1 (or of its protrusion 14).

Figure 2A:
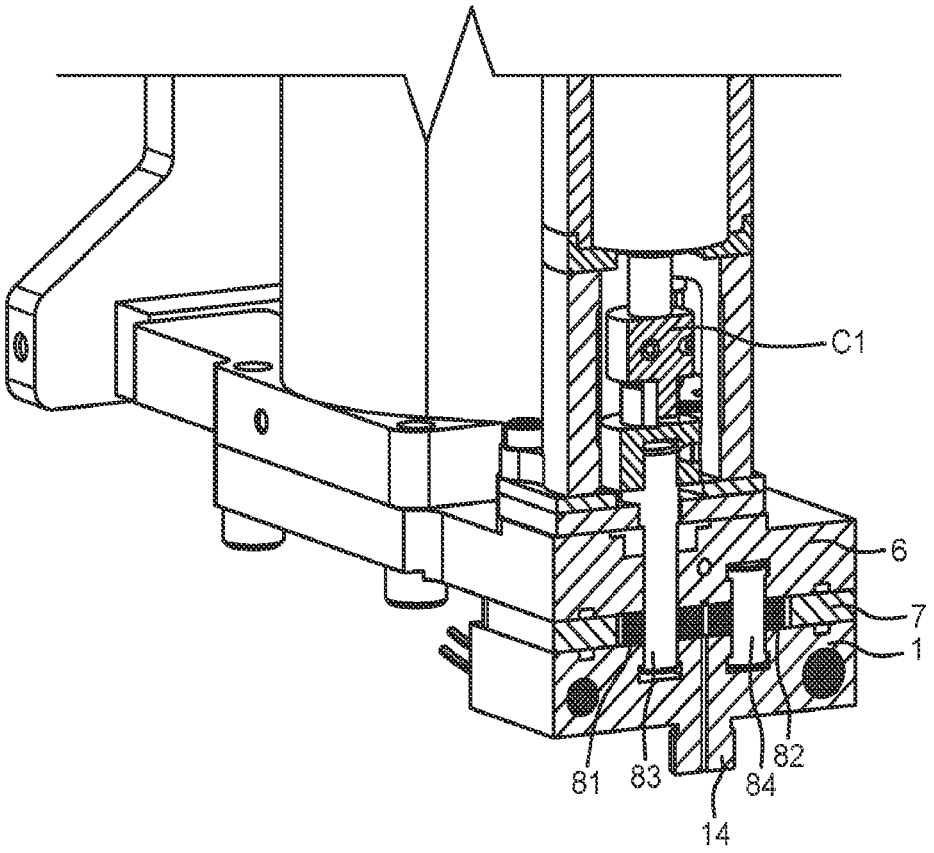
FIG. 2*a* is a partial enlarged cross-sectional view of the VCP of the coating system.
Figure 4:
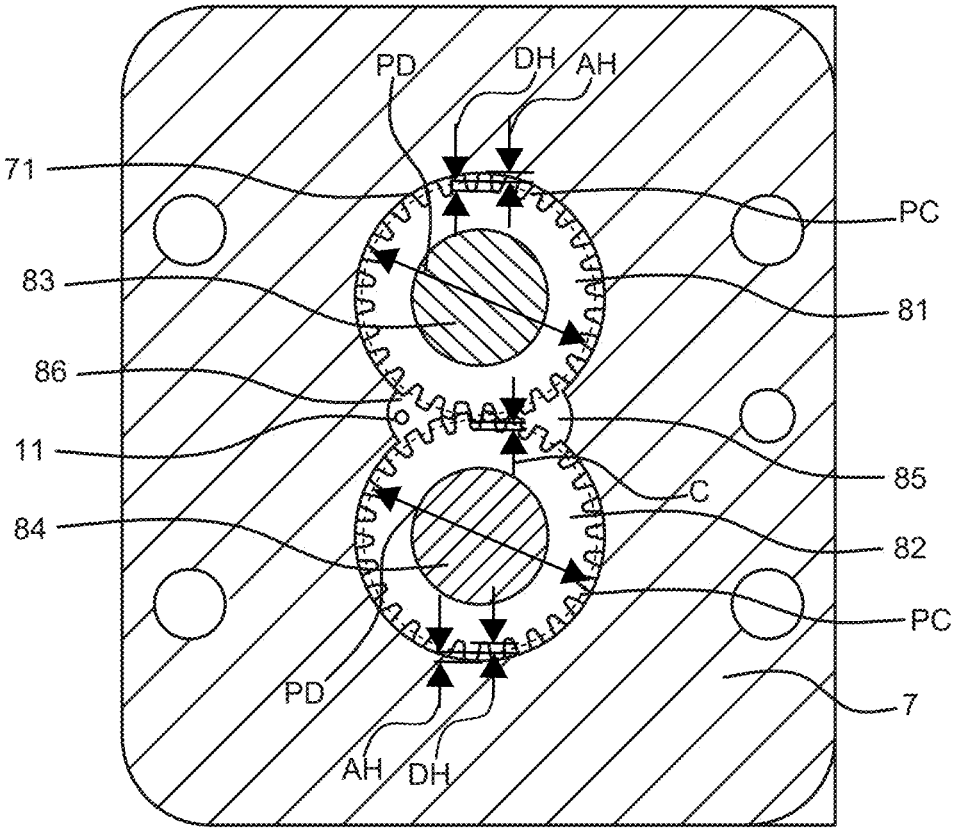
FIG. 4 is a schematic diagram of a cross-sectional view taken along the line IV-IV in FIG. 2, in which the arrangement of a gear set and its fluid inlet and fluid outlet is shown.

As shown in FIGS. 2*a* and 4, the gear fixing plate 7 according to the embodiment has an aperture 71, and the gear set 8 is located in the aperture 71 of the gear fixing plate 7. The gears of the gear set 8 have approximately the same thickness as the gear fixing plate 7. The gear set 8 includes a driving gear 81 and a driven gear 82, a driving shaft 83 on which the driving gear 81 is mounted, and a driven shaft 84 on which the driven gear 82 is mounted. The driving gear 81 and the driven gear 82 may be constituted by a pair of spur gears. However, this is not restrictive, and other forms of gears are conceivable. The driving gear 81 can mesh with the driven gear 82 to discharge the fluid from one side of the gear set to the other side thereof. Specifically, as shown in FIG. 4, when the driving gear 81 rotates counterclockwise, the fluid from one side of the plane where the gear set 8 is located, i.e., the fluid inlet 85, is carried by the teeth of gears 81, 82, until the fluid flows out from the other side of the plane where the gear set 8 is located, i.e., the fluid outlet 86.

In particular, the gears of the gear set 8 are customized gears rather than standard gears. In other words, the gears of the gear set 8 are non-standard gears. Specifically, the gear set 8 is designed such that addendum height coefficients of the driving gear and the driven gear are greater than addendum clearance coefficients thereof. FIG. 4 schematically represents a pitch circle PC (represented in dashed lines), a pitch diameter PD, an addendum height AH, a dedendum height DH, and a clearance C of the driving gear 80 and the driven gear 82. Depending on the cooperation of the driving gear 80 and the driven gear 82 of the gear set 8 in the present invention, a precise amount of fluid may be discharged to the discharge port 86 of the gear set 8. Thus, improved fluid transport performance may be obtained.

Preferably, each of the driving gear 81 and the driven gear 82 of the gear set 8 has an addendum height coefficient of 0.7 and an addendum clearance coefficient of 0.3. Thus, optimal fluid transport performance may be obtained.

Accordingly, a pair of, for example, spur gears are specially designed to obtain a very small volume of fluid with high precision for each revolution of the gears. Meanwhile, this gear set may be made of tool steel, which is a hardened material for high durability and high surface finish. Obviously, the VCP distribution system of the present invention can continuously and accurately deliver a fluid such as hot glue to the end of the nozzle.

FIG. 2*a* is a partial enlarged cross-sectional view of the VCP of the coating system. Unlike in the prior art, which usually uses an idler gear as the driven gear, the driven gear 82 according to the embodiment has a driven shaft 84, as shown in FIG. 2*a*. The driven gear 82 is supported on the driven shaft 84 for rotation. The driven shaft 84 passes through the gear fixing plate 7. One end of the driven shaft 84 is inserted into the flow passage plate 6, and the other end thereof is inserted into the nozzle plate 1.

Thus, the driven shaft 84 is not only used for gear rotation but also used as a positioning pin shaft for positioning the driven gear 82. The positioning pin shaft is used to accurately position the nozzle plate 1, the gear fixing plate 7 and the flow passage plate 6. Accordingly, in essence, this design is completely different from any existing metering system.

The fluid outlet of the metering distribution assembly 16, i.e., the fluid outlet 86 of the gear set 8, is in fluid communication with one end, i.e., an upper end, of the flow passage 11. The fluid from the fluid outlet 86 of the gear set 8 may be discharged in a straight line along the flow passage 11. Thus, a linear feed/direct feed mode is formed. The other end, i.e., a lower end, of the flow passage 11 or the discharge port 141 is in fluid communication with the nozzle 10. Accordingly, the fluid from the gear set 8 of the metering distribution assembly 16 is distributed to the outside of the coating system via the flow passage 11 and the nozzle 10, for example, to the surface of a workpiece. Compared with the volumetric cavity pump with a shut-off module, this direct-fed volumetric cavity pump has many advantages: a simple flow passage design; a relatively low manufacture cost; a good cut-off line end pattern with no glue hammer; convenient maintenance; and a short outflow length, which is suitable for a high-viscosity material and the like.

Continuing to refer to FIGS. 2-4, the driving assembly 3 of the coating system includes a housing 31, and a motor 30 arranged in the housing 31. The motor 30 is, for example and not limited to, a DC stepper motor or an inverse servo motor, the actuation and rotation of which cause selective distribution of the fluid. More specifically, the motor 30 is coupled to the driving gear 81 through a motor shaft in a manner known in the art, so that its rotation causes the driving gear 81 and the driven gear 82 to rotate so as to meter the fluid. More specifically, the motor rotor is connected to the motor shaft through a flexible coupling clutch, and the motor shaft is in turn connected to the driving shaft 83 of the driving gear 81 through the flexible coupling clutch. Thus, the rotation of the motor shaft causes the rotation of the driving gear 81.

The coating system further includes an electrical junction box assembly 5, which includes wiring terminals and the like. The heating elements, such as heating rods and/or temperature sensor signal wires, are connected to a controller (not shown) of the coating system through the electrical junction box assembly 5.

When the coating system operates, the rotation of the motor rotor drives the driving shaft 83 to rotate, so that the gear 81 and the gear 82 mesh. Owing to the rotation of the gears of the gear set 8, the fluid from the barrel assembly 4 flows through the flow passage in the flow passage plate 6, passes through the gear set 8, and is continuously extruded from the discharge port 86 of the gear set 8 so as to be discharged via the discharge port 141 of the protrusion 14 of the nozzle plate 1. Taking into account the working principle of the volumetric cavity pump, its output volumes are very accurate and consistent.

Figure 5:
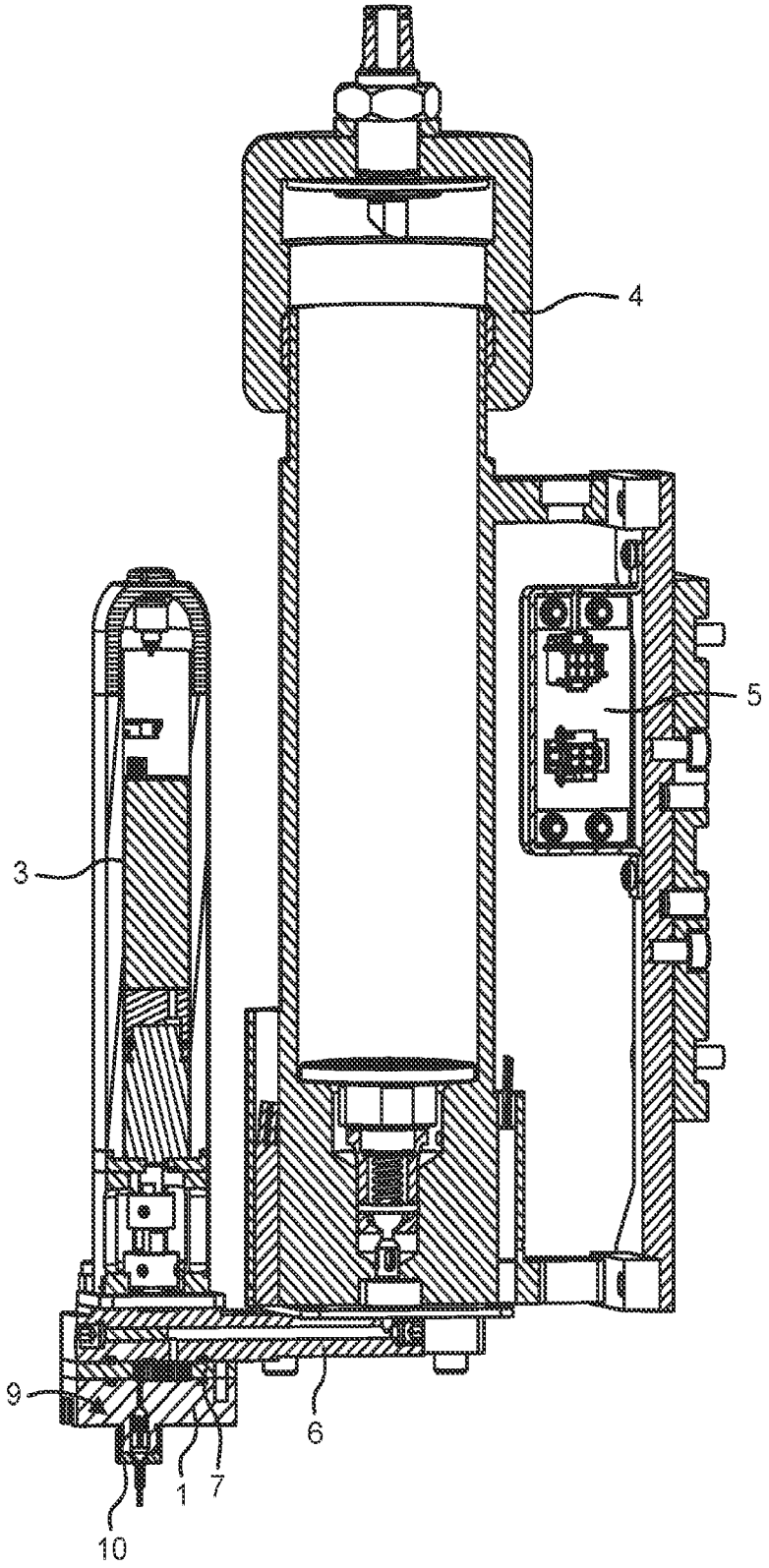
FIG. 5 is a view showing the driving assembly and VCP of a coating system according to a second embodiment of the present invention in a cross-sectional form, in which a pressure control check valve located in a nozzle plate is shown.
Figure 6:
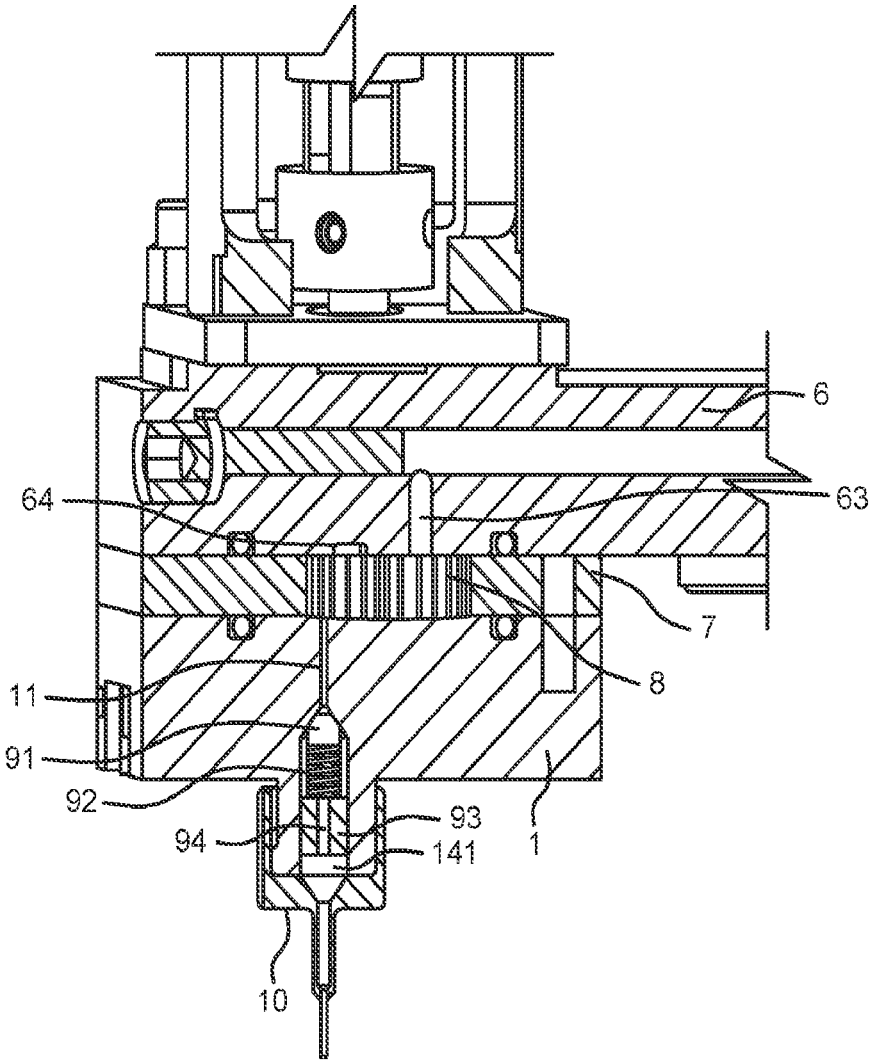
FIG. 6 is a view showing the pressure control check valve in an enlarged form.

FIG. 5 is a view showing a coating system according to a second embodiment of the present invention in a cross-sectional form, in which a pressure control check valve located in the nozzle plate 1 is shown, and FIG. 6 is a view showing the pressure control check valve in an enlarged form. For ease of description, the same reference signs in FIGS. 5-6 indicate the same features in FIGS. 1-4, and these same features may be referred to in order to understand the features and/or functions of the coating system. Referring to FIGS. 5-6, the coating system is also provided with a pressure control check valve 9. The pressure control check valve 9 is provided in the nozzle plate 1.

As clearly shown in FIG. 6, the pressure control check valve 9 includes a ball 91, a spring 92 supporting the ball, a spring seat 93, and a seat flow passage 94 in the spring seat 93. The flow passage 11 of the nozzle plate 1 has a smaller diameter portion and a larger diameter portion, the smaller diameter portion being in fluid communication with the gear set 8, and the larger diameter portion being located downstream of the smaller diameter portion in a fluid flow direction. The pressure control check valve 9 is provided in the flow passage 11 of the nozzle plate 1, specifically in the larger diameter portion. When the pressure of a fluid in the smaller diameter portion is greater than a predetermined threshold, the ball 91 leaves the ball seat and moves downward, whereby the pressure control check valve 9 is opened to allow the fluid to flow through the seat flow passage 94 of the pressure control check valve 9 to the discharge port 141 of the nozzle plate 1, thereby distributing the fluid to the outside of the nozzle plate 1, for example, to the surface of a workpiece through the nozzle 10.

On the other hand, when the pressure of the fluid in the smaller diameter portion is less than or equal to the predetermined threshold, the ball 91 abuts upward on the ball seat, whereby the pressure control check valve 9 is closed. Accordingly, the fluid is held in the smaller diameter portion of the flow passage 11 of the nozzle plate 1 and cannot flow out.

With the above configuration, when the coating system is closed, the leakage of the fluid may be effectively controlled in time, and the formation of a large fluid head may be effectively prevented at the end of the coating operation.

Figure 7:
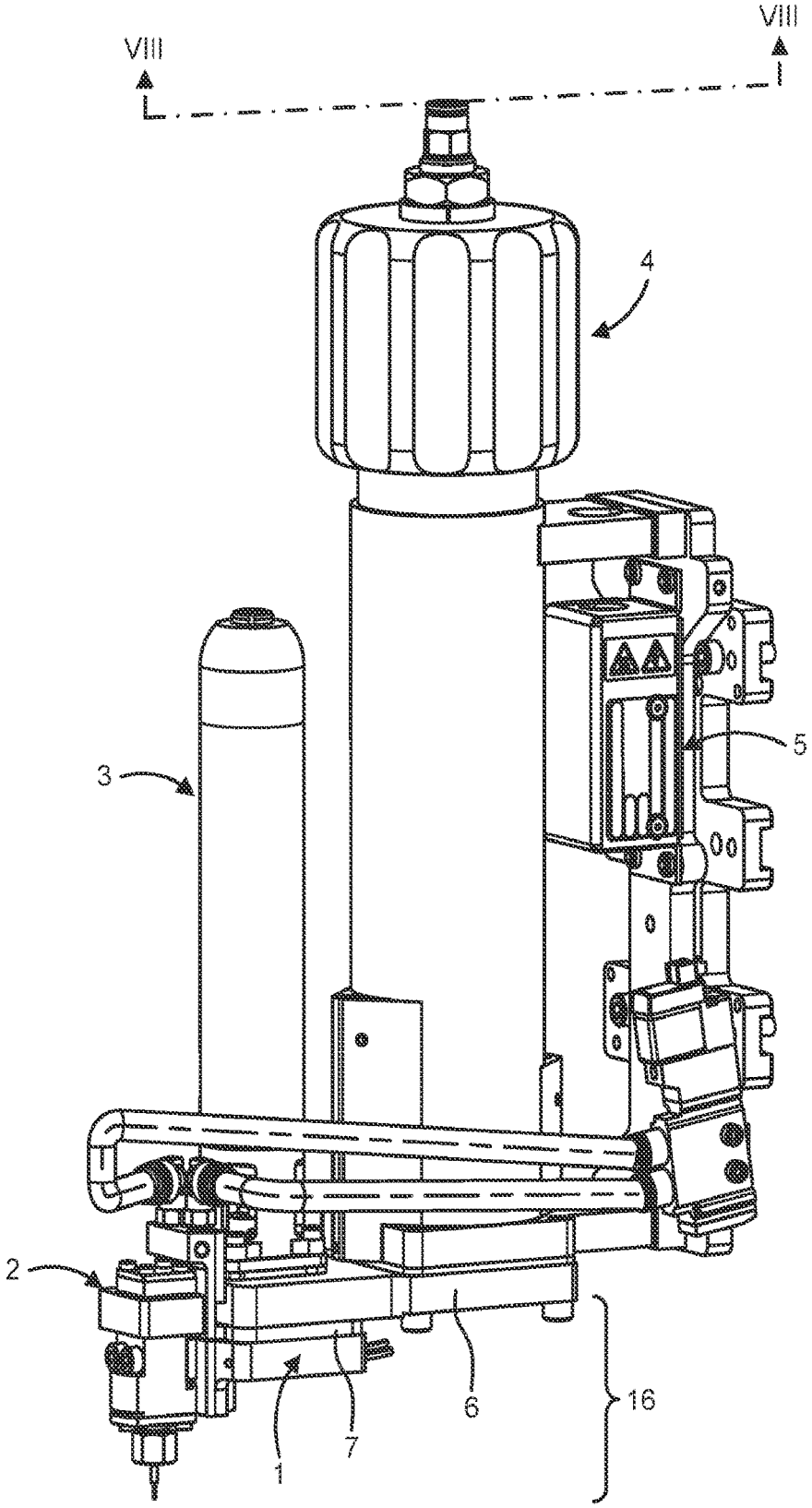
FIG. 7 is a perspective view of a coating system embedded with the VCP according to a third embodiment of the present invention, wherein the coating system has a control valve assembly.
Figure 8:
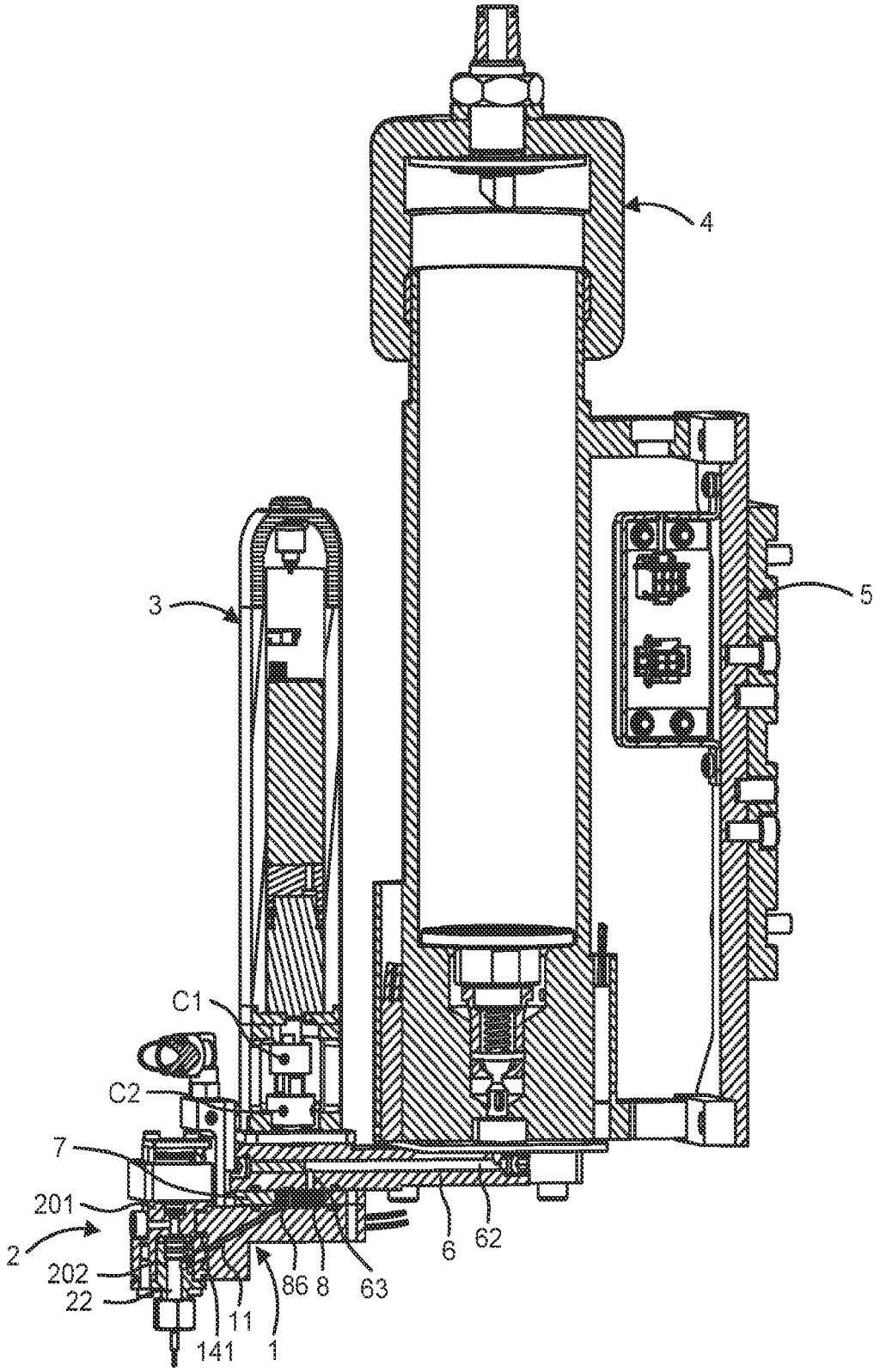
FIG. 8 is a cross-sectional view taken along the line VIII-VIII in FIG. 7.

FIG. 7 is a perspective view of a coating system embedded with the VCP according to a third embodiment of the present invention, wherein the coating system has a control valve assembly. FIG. 8 is a cross-sectional view taken along the line VIII-VIII in FIG. 7. For ease of description, the same reference signs in FIG. 7 indicate the same features in FIGS. 1-6, and these same features may be referred to in order to also understand the features and/or functions of the coating system. Referring to FIGS. 7-8, the coating system is also provided with a control valve assembly 2. The control valve assembly 2 is located on a side of the driving assembly 3 approximately opposite to the barrel assembly 4, and is mounted on the nozzle plate 1 by screws, for example.

Figure 10:
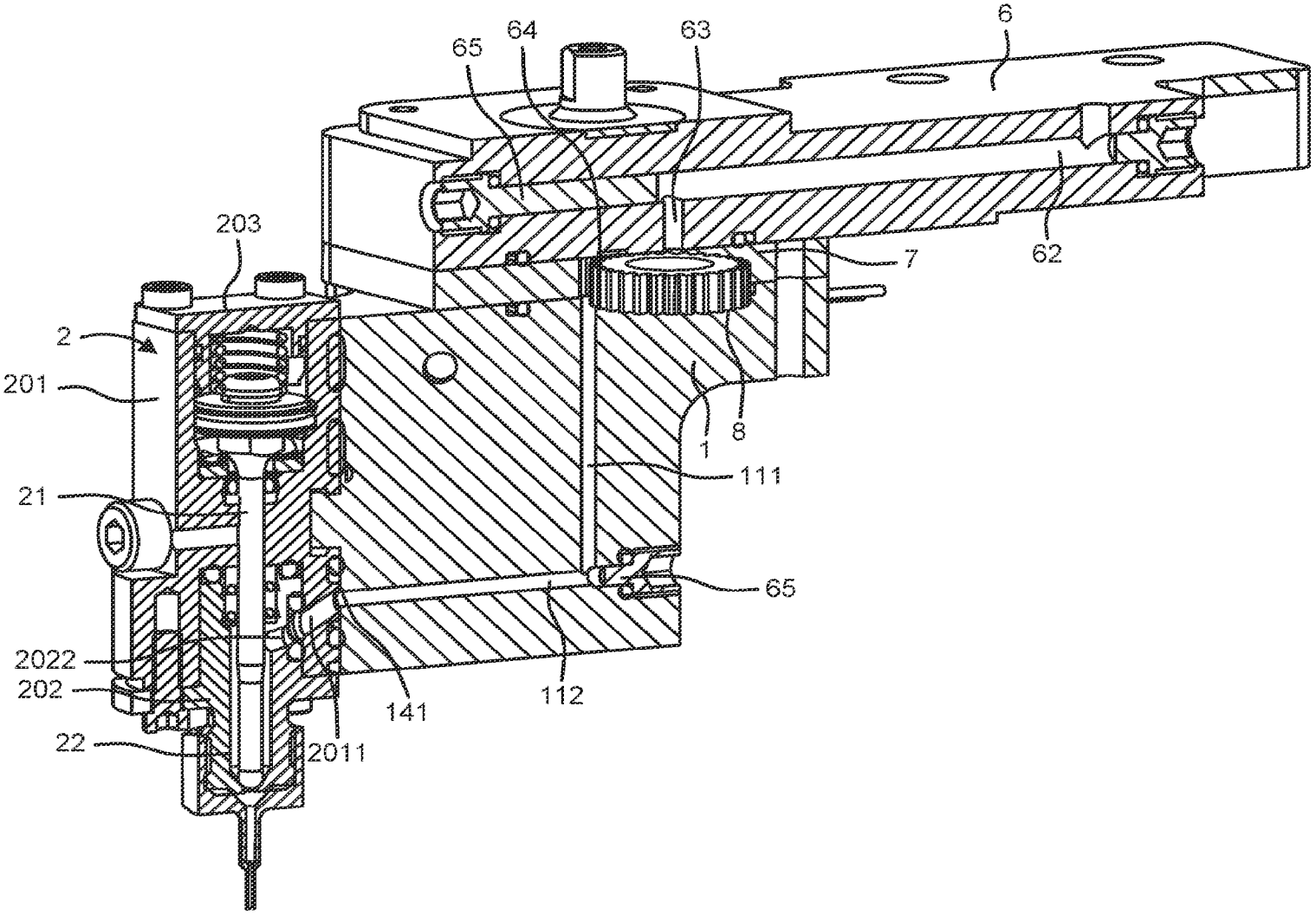
FIG. 10 is the coating system embedded with the VCP according to the third embodiment of the present invention, in which the arrangement of the flow passage in the nozzle plate is shown in a cross-sectional form.

As shown in FIGS. 8 and 10, the control valve assembly 2 includes a needle housing 201, a passage housing 202, and a top cover 203. The needle housing 201 and the top cover 203 are attached together to form an internal space. The passage housing 202 is attached to the needle housing 201 on a side of the needle housing 201 opposite to the top cover 203. The control valve assembly 2 has a needle 21 and a needle passage 22, the needle being movable in the needle passage for opening and closing the needle passage 22. The needle passage 22 is located inside the passage housing 202. The needle passage 22 is in fluid communication with the flow passage of the nozzle plate 1, for example, by means of a transfer passage 2011 on the needle housing 201 and a transfer passage 2021 on the passage housing 202. The axis of the needle 21 is consistent with the passage axis of the needle passage 22. When the needle 21 moves downward in the needle passage 22, the tip of the needle 21 can abut against the needle seat in the needle passage 22, thereby closing the needle passage 22. On the contrary, when the needle 21 moves upward in the needle passage 22, i.e., moving away from the needle seat, the needle passage 22 is opened and thus the fluid can flow from the needle passage 22 to the outside. The control valve assembly is an integral component. The control valve assembly 2 separately forms a shut-off module independently of the nozzle plate 1. The control valve assembly 2 is attached to the nozzle plate 1, thereby having many benefits for improving heating efficiency and fluid mobility. The nozzle may be further attached to the end of the control valve assembly 2. During operation, the fluid flows from the discharge port of the gear set 8 through the nozzle plate 1 and then is directly injected into the control valve assembly 2 as a shut-off valve, and, finally, the fluid flows out of the nozzle with the control of the shut-off valve.

In the case where an independent shut-off valve is provided, the flow passage of the nozzle plate 1 can adopt a variety of configurations. For example, as shown in FIG. 8, the flow passage of the nozzle plate 1 is an integrated flow passage 11 inclined with respect to the rotation axis of the gear set 8; while as shown in FIG. 10, the flow passage of the nozzle plate 1 includes a first flow passage 111 and a second flow passage 112, the first flow passage 111 extending from the fluid outlet 86 of the gear set 8, the second flow passage 112 extending at an angle (preferably, orthogonally) to the first flow passage 111 and being in fluid communication with the needle passage 22.

In the coating system of the prior art, after the coating system is closed, a small part of the fluid still flows from the pump toward the nozzle, which would cause a fluid hammer on the surface of the workpiece. However, in the present invention, as clearly shown in FIG. 10, when the needle 21 of the control valve assembly 2 abuts against the needle seat in the flow passage 22 of the control valve assembly 2 to stop the flow of the fluid, the fluid from the pump assembly 8 would flow into a mold cavity of the shut-off module, specifically into a moving space of the needle 21, but cannot be discharged from the control valve assembly 2. Therefore, compared with the first embodiment, the shut-off module enables the coating system to effectively prevent the heated fluid from continuously flowing out of the nozzle after the volumetric cavity pump is closed.

Figure 9:
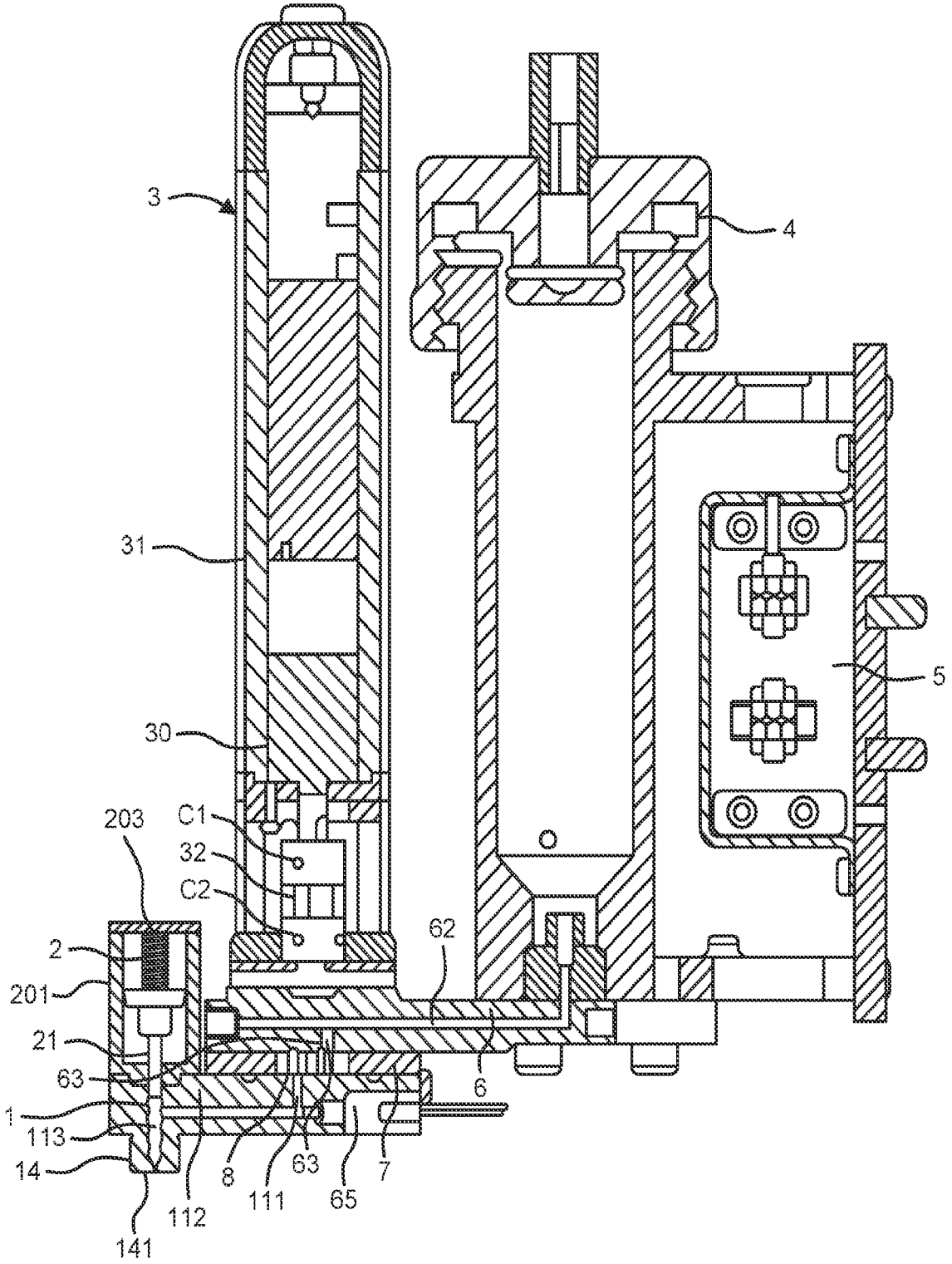
FIG. 9 is the coating system embedded with the VCP according to the third embodiment of the present invention, in which the arrangement of a flow passage in a nozzle plate is shown in a cross-sectional form.

As an alternative to a separate shut-off valve or an integral component, the control valve assembly 2 can also be formed by means of the nozzle plate 1. Specifically, as shown in FIG. 9, the control valve assembly 2 includes a needle housing 201 and a top cover 203, but does not have a passage housing as shown in FIG. 10. The flow passage of the nozzle plate 1 includes a first flow passage 111, a second flow passage 112 and a third flow passage 113, the first flow passage 111 extending from the fluid outlet 86 of the gear set 8, the second flow passage 112 fluidly communicating the first flow passage 111 and the third flow passage 113, the third flow passage 113 extending to the discharge port 141 of the nozzle plate 1. The needle housing 201 of the control valve assembly 2 is attached to the nozzle plate 1 so that the tip of the needle 21 of the control valve assembly 2 is movable in the third flow passage 113 to control the distribution of the fluid from the nozzle plate 1. Thus, the third flow passage 113 of the nozzle plate 1 functions as the passage 22 in FIG. 10.

The motor rotor of the motor 30 is flexibly connected to the gear set 8. Specifically, the motor rotor is connected to the motor shaft 32 through a flexible coupling clutch C1, and the motor shaft 32 is in turn connected to the driving shaft 83 of the gear set 8 through a flexible coupling clutch C2 (see FIG. 3).

Therefore, in the embodiment shown in FIG. 9, the control valve assembly 2 as a shut-off valve is designed integrally with the nozzle plate 1. The advantages of this design are to further optimize the flow passage design and reduce the flow resistance of the fluid, thereby improving the coating effect of the fluid (such as a gluing effect).

Generally, when manufacturing the gears and the fixing plates, machining and assembly tolerances certainly exist. Therefore, a gap between the gear teeth and the housing is unavoidable. Due to this gap, even if the VCP stops rotating, there would still be droplets and leakage at the tip of the nozzle. However, the present invention combines the intelligent coating modules into a VCP distributor, and the fluid must flow into a mold cavity formed by the control valve assembly 2 and the nozzle plate 1 together before exiting the nozzle 10. The needle 21 in the mold cavity moves up and down to act as a switch, thereby preventing droplets and leakage at the nozzle tip after the VCP is closed.

Moreover, the coating system of the present invention completely inherits the distribution function of the ordinary VCP. This coating system, which is a compact and exquisite design, is very easy to maintain and operate, and prevents leakage of the fluid.

Figure 11:
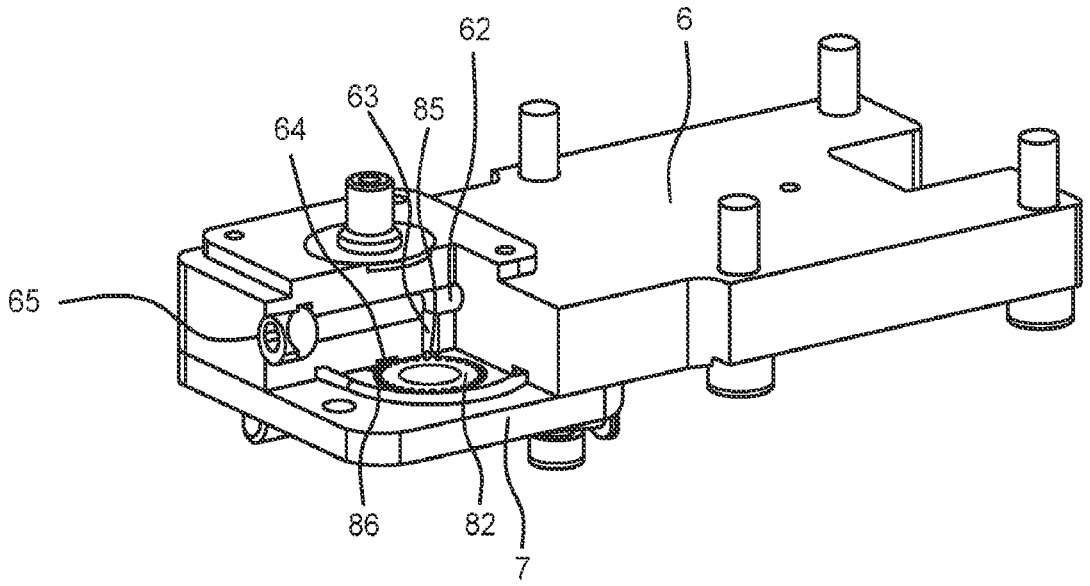
FIG. 11 is a partial perspective view with a part of a top flow passage plate removed, in which a groove in the top flow passage plate is shown.

FIG. 11 is a partial perspective view with a part of a top flow passage plate removed, in which a groove in the top flow passage plate is shown. As shown in FIG. 11, on a side of the flow passage plate 6 facing the gear set 8, a groove 64 is formed in an area corresponding to the fluid outlet 86 of the gear set 8. The contour and position of the groove are designed to reduce a hydraulic pressure of the fluid trapped by the meshed gear teeth. Accordingly, the flow stability of the fluid is improved.

Further, the coating system is further provided with a plug rod 65. The plug rod 65 is inserted into the flow passage of the coating system to block one end of the flow passage. For example, the plug rod 65 is inserted into an approximately horizontal flow passage 62 of the flow passage plate 6 from one side, so that the fluid is diverted in the flow passage. The length and end shape of the plug rod 65 are designed such that the plug rod can appropriately eliminate a fluid dead end in the flow passage. If necessary, the plug rod 65 may be removed for the convenience of cleaning and maintenance of the flow passage.

The thickness of the gears of the gear set 8 is of the same nominal size as the thickness of the gear fixing plate 7. While ensuring that the gear can move freely in the contour of the fixing plate 7, the thickness tolerances of the two may be appropriately selected.

Any of the coating systems according to the present invention may be configured to respond to an analog signal from a speed sensing device (not shown), which analog signal is proportional to the speed of any robot that can carry the device. Such an analog signal may be supplied, for example, to a microprocessor (not shown) electrically coupled to the corresponding motor. Additional control features include arranging the ability to reverse an adhesive flow at the end of the cycle, with a microprocessor, by reversing the rotation direction and/or speed of the motor and/or gear set. Reversing the rotation direction and/or speed of the motor and/or pump at the end of each cycle can also help to maintain tight control over several parts of the fluid that may remain in the flow passage or conduit between applications.

Although the present invention has been illustrated by the description of various embodiments and these embodiments have been described in considerable detail, it is not intended to restrict or limit, in any manner, the scopes of the appended claims to such details. Those skilled in the art will easily understand additional advantages and modifications. Therefore, the present invention, in its broader aspects, is not limited to the specific details, representative devices and methods, and illustrative examples shown and described. In consequence, such details may be deviated without departing from the spirit or scope of the general inventive concept.

LIST OF REFERENCE SIGNS

1: nozzle plate
10: nozzle
101: thin-walled hollow tube
11: flow passage
111: flow passage
112: flow passage
113: flow passage
14: protrusion
141: discharge port
2: control valve assembly
201: needle housing
2011: transfer passage
202: passage housing
2021: transfer passage
203: top cover
21: needle
22: needle passage

3: driving assembly
30: motor
31: housing
32: motor shaft
4: barrel assembly
40: housing
41: proximal end
42: distal end
421: discharge port
43: cover
430: cover passage
5: electrical junction box assembly
6: flow passage plate
61: flow passage
62: flow passage
63: flow passage
64: groove
65: plug rod
7: gear fixing plate
71: aperture
8: gear set
81: driving gear
82: driven gear
83: driving shaft
84: driven shaft
c1: flexible coupling clutch
c2: flexible coupling clutch

The invention claimed is:

1. A metering distribution assembly composed of a volumetric cavity pump comprising:

a flow passage plate provided with flow passages for fluid flow;

a nozzle plate provided with a flow passage through the nozzle plate;

a gear fixing plate attached between the flow passage plate and the nozzle plate and having an aperture; and a gear set located in the aperture of the gear fixing plate, the gear set having a fluid inlet and a fluid outlet on a side of the gear set opposite to the fluid inlet, the fluid inlet being in fluid communication with the flow passages of the flow passage plate, and the fluid outlet being in fluid communication with the flow passage of the nozzle plate; and a nozzle coupled to the nozzle plate or coupled to a control valve assembly that is coupled to the nozzle plate, wherein a part of the flow passages of the flow passage plate, which is in direct fluid communication with the fluid inlet, extends in a direction parallel to a rotation axis of the gear set, wherein the flow passage plate has a first flow passage, a second flow passage and a third flow passage, the first flow passage receiving a fluid from outside, the second flow passage fluidly communicating the first flow passage and the third flow passage, and the third flow passage being in direct fluid communication with the fluid inlet, and wherein a first end, of the third flow passage, is offset from the gear fixing plate and is configured to receive the fluid flow from the second flow passage and configured to direct the fluid flow to a second end of the third flow passage, wherein the second end is configured to direct the fluid flow directly to the fluid inlet of the gear set in the direction that is parallel to the rotation axis of the gear set.

2. The metering distribution assembly according to claim 1, wherein the third flow passage is entirely defined by the flow passage plate.

3. The metering distribution assembly according to claim 2, wherein each of the first flow passage, the second flow passage, the third flow passage, and the flow passage of the nozzle plate are straight.

4. The metering distribution assembly according to claim 1, wherein the gear set includes a driving gear and a driven gear, the driving gear being drivable to rotate, thereby driving the driven gear to rotate, wherein the driving gear and the driven gear are non-standard gears, and wherein the driving gear and the driven gear each have an addendum height coefficient and an addendum clearance coefficient that is less than the respective addendum height coefficient.

5. The metering distribution assembly according to claim 4, wherein each addendum height coefficient is 0.7, and each addendum clearance coefficient is 0.3.

6. The metering distribution assembly according to claim 4, wherein the driven gear has a gear shaft.

7. The metering distribution assembly according to claim 1, wherein the metering distribution assembly is provided with the control valve assembly, which has a needle, for controlling distribution of a fluid from the metering distribution assembly.

8. The metering distribution assembly according to claim 7, wherein the control valve assembly is an integral component attached to the nozzle plate, the control valve assembly including a needle passage, the needle being movable in the needle passage, the needle passage being in fluid communication with the flow passage of the nozzle plate.

9. The metering distribution assembly according to claim 8, wherein the flow passage of the nozzle plate is a straight flow passage inclined with respect to the rotation axis of the gear set.

10. The metering distribution assembly according to claim 8, wherein the flow passage of the nozzle plate includes a first flow passage and a second flow passage, the first flow passage extending from the fluid outlet of the gear set, the second flow passage extending at an angle to the first flow passage and being in fluid communication with the needle passage.

11. The metering distribution assembly according to claim 7, wherein the control valve assembly includes a needle housing and a top cover, the top cover being attached to the needle housing to form an internal space, in which one end of the needle is accommodated;

the flow passage of the nozzle plate includes a first flow passage, a second flow passage and a third flow passage, the first flow passage extending from the fluid outlet of the gear set, the second flow passage fluidly communicating the first flow passage and the third flow passage, the third flow passage extending to a discharge port of the nozzle plate; and the needle housing of the control valve assembly is attached to the nozzle plate, so that the other end of the needle of the control valve assembly is movable in the third flow passage to control distribution of the fluid from the nozzle plate.

12. The metering distribution assembly according to claim 1, wherein, on a side of the flow passage plate facing the gear set, a groove is formed in an area corresponding to the fluid outlet of the gear set.

13. The metering distribution assembly according to claim 1, wherein a plug rod is provided, which is designed to be inserted into the flow passages of the metering distribution assembly, for eliminating a fluid dead end in the flow passages.

14. The metering distribution assembly according to claim 1, wherein a thickness of a driving gear and a driven gear of the gear set is of the same nominal size as a thickness of the gear fixing plate.

15. A coating system comprising:

a barrel assembly comprising a barrel for accommodating a fluid; a metering distribution assembly according to claim 1, the metering distribution assembly being attached to and in fluid communication with the barrel assembly; and a driving assembly for driving the metering distribution assembly to distribute the fluid from the barrel assembly via the metering distribution assembly.

16. The metering distribution assembly according to claim 1, wherein 1) the nozzle is coupled to a protrusion of the nozzle plate, or 2) wherein the nozzle is attached to an end of the control valve assembly that is attached to the nozzle plate, and the fluid outlet of the gear set and the nozzle plate are configured such that during operation fluid flows from the fluid outlet of the gear set through the nozzle plate and then is directly injected into the control valve assembly which forms a shut-off valve, and, then, the fluid flows out of the nozzle with the control of the shut-off valve.

17. The metering distribution assembly according to claim 1, wherein the gear set includes a gear shaft, wherein one end of the gear shaft is inserted into the flow passage plate, and the other end is inserted into the nozzle plate.

18. A metering distribution assembly composed of a volumetric cavity pump comprising:

a flow passage plate provided with flow passages for fluid flow;

a nozzle plate provided with a flow passage through the nozzle plate;

a gear fixing plate attached between the flow passage plate and the nozzle plate and having an aperture; and a gear set located in the aperture of the gear fixing plate, the gear set having a fluid inlet and a fluid outlet on a side of the gear set opposite to the fluid inlet, the fluid inlet being in fluid communication with the flow passages of the flow passage plate, and the fluid outlet being in fluid communication with the flow passage of the nozzle plate; and a nozzle coupled to the nozzle plate or coupled to a control valve assembly that is coupled to the nozzle plate, wherein a part of the flow passages of the flow passage plate, which is in direct fluid communication with the fluid inlet, extends in a direction parallel to a rotation axis of the gear set, and wherein the gear set comprises a gear shaft, and wherein one end of the gear shaft is inserted into the flow passage plate, and the other end of the gear shaft is inserted into the nozzle plate.

19. The metering distribution assembly according to claim 18, wherein the gear set comprises a driving gear and a driven gear, the driving gear being drivable to rotate, thereby driving the driven gear to rotate, and wherein the driven gear comprises the gear shaft.

20. A metering distribution assembly composed of a volumetric cavity pump comprising:

a flow passage plate provided with flow passages for fluid flow;

a nozzle plate provided with a flow passage through the nozzle plate;

a gear fixing plate attached between the flow passage plate and the nozzle plate and having an aperture; and a gear set located in the aperture of the gear fixing plate, the gear set having a fluid inlet and a fluid outlet on a side of the gear set opposite to the fluid inlet, the fluid inlet being in fluid communication with the flow passages of the flow passage plate, and the fluid outlet being in fluid communication with the flow passage of the nozzle plate; and a nozzle coupled to the nozzle plate or coupled to a control valve assembly that is coupled to the nozzle plate, wherein a part of the flow passages of the flow passage plate, which is in direct fluid communication with the fluid inlet, extends in a direction parallel to a rotation axis of the gear set, and wherein a pressure control check valve is provided in the flow passage of the nozzle plate to open or close the flow passage of the nozzle plate.

* * * * *